US008257804B2

(12) United States Patent
Asakawa et al.

(10) Patent No.: US 8,257,804 B2
(45) Date of Patent: Sep. 4, 2012

(54) DOUBLE-SIDED RECORDING MEDIUM

(75) Inventors: Hiroshi Asakawa, Ebina (JP); Hitoshi Nagashima, Kawasaki (JP); Takatoshi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 13/014,641

(22) Filed: Jan. 26, 2011

(65) Prior Publication Data

US 2011/0183087 A1 Jul. 28, 2011

(30) Foreign Application Priority Data

Jan. 28, 2010 (JP) ..... 2010-017008
Dec. 13, 2010 (JP) ..... 2010-277324

(51) Int. Cl.
*B41M 5/00* (2006.01)

(52) U.S. Cl. ..... 428/32.24; 428/32.25; 428/32.31; 428/32.32; 428/32.34

(58) Field of Classification Search ..... 428/32.24, 428/32.25, 32.31, 32.32, 32.34
See application file for complete search history.

(56) References Cited

U.S. PATENT DOCUMENTS

| | | | | |
|---|---|---|---|---|
| 6,432,550 | B1 | 8/2002 | Ohbayashi | |
| 2002/0025413 | A1 * | 2/2002 | Ohbayashi et al. | 428/195 |
| 2006/0187293 | A1 * | 8/2006 | Thomas | 347/187 |
| 2007/0231511 | A1 * | 10/2007 | Okuda et al. | 428/32.34 |

FOREIGN PATENT DOCUMENTS

| | | | |
|---|---|---|---|
| EP | 791474 | A2 | 8/1997 |
| EP | 0791474 | A2 | 8/1997 |
| JP | 9-286166 | A | 11/1997 |
| JP | 2000-141880 | A | 5/2000 |
| JP | 2001-080208 | A | 3/2001 |

* cited by examiner

*Primary Examiner* — Betelhem Shewareged
(74) *Attorney, Agent, or Firm* — Canon U.S.A., Inc., IP Division

(57) ABSTRACT

A recording medium includes a substrate and two or more ink receiving layers on each of a first surface and a second surface of the substrate. The ink receiving layers each contain a pigment and a binder. $A_1$, $A_2$, $B_1$, and $B_2$ (nm) satisfy the relationships (1), (2), and (3), where $A_1$ is the peak of the pore radius distribution of the outermost ink receiving layer on the first surface side, $A_2$ is the peak of the pore radius distribution of the ink receiving layer adjacent to the outermost layer, $B_1$ is the peak of the pore radius distribution of the outermost ink receiving layer on the second surface side, and $B_2$ is the peak of the pore radius distribution of the ink receiving layer adjacent to the outermost layer. The arithmetic average roughness Ra specified in JIS B 0601 of each of the outermost ink receiving layers is 0.50 μm or more.

5 Claims, 1 Drawing Sheet

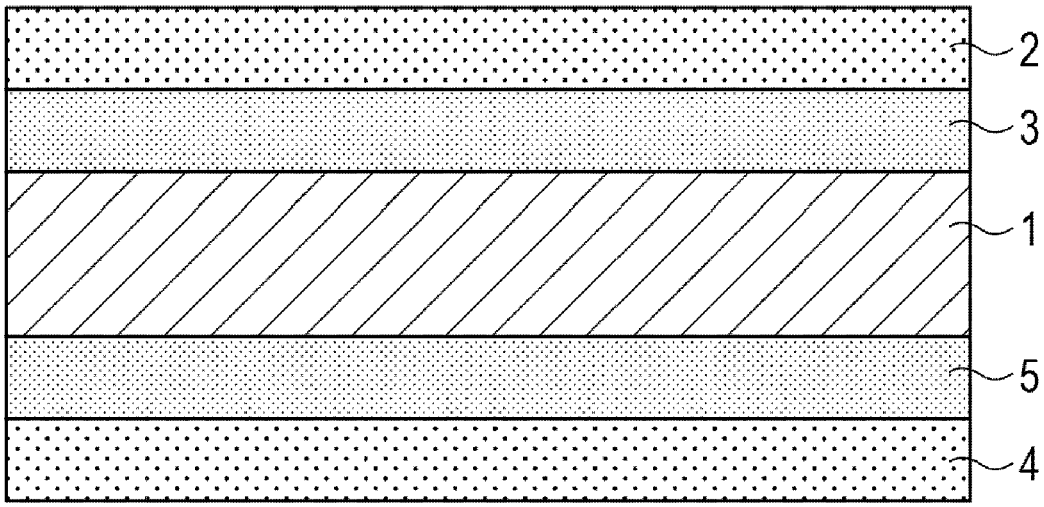
2
3
1
5
4

DOUBLE-SIDED RECORDING MEDIUM

BACKGROUND OF THE INVENTION

1. Field of the Invention

The present invention relates to a double-sided recording medium, with which recording can be performed on both sides thereof.

2. Description of the Related Art

Recording media, in particular, those used in ink jet recording, generally include an ink receiving layer having a porous structure in which silica or hydrated alumina, as a pigment, is held by a binder.

Double-sided recording capability is one of the characteristics required for such a recording medium. In response to such a requirement, Japanese Patent Laid-Open No. 9-286166 (Patent Document 1) discloses an ink jet recording medium (double-sided recording medium) including ink receiving layers or coat layers provided on both surfaces of a substrate. Furthermore, Japanese Patent Laid-Open No. 2001-80208 (Patent Document 2) discloses an ink jet recording medium (double-sided recording medium) including ink absorption layers containing a cationic compound on both surfaces of a substrate having a specific opacity.

SUMMARY OF THE INVENTION

The present invention provides a recording medium including a substrate, two or more ink receiving layers disposed on a first surface of the substrate, and two or more ink receiving layers disposed on a second surface of the substrate, the second surface being opposite the first surface. The ink receiving layers each contain a pigment and a binder. The relationships (1) $A_1>A_2$, (2) $B_1>B_2$, and (3) $|A_1-B_1|\leqq 1.0$ are satisfied, where $A_1$ is the peak (in units of nm) of the pore radius distribution of the outermost ink receiving layer on the first surface side, $A_2$ is the peak (in units of nm) of the pore radius distribution of the ink receiving layer adjacent to the outermost ink receiving layer on the first surface side, $B_1$ is the peak (in units of nm) of the pore radius distribution of the outermost ink receiving layer on the second surface side, and $B_2$ is the peak (in units of nm) of the pore radius distribution of the ink receiving layer adjacent to the outermost ink receiving layer on the second surface side. The arithmetic average roughness Ra, which is specified in JIS B 0601, of each of the outermost ink receiving layer on the first surface side and the outermost ink receiving layer on the second surface side is 0.50 μm or more.

Further features of the present invention will become apparent from the following description of exemplary embodiments with reference to the attached drawing.

BRIEF DESCRIPTION OF THE DRAWING

Figure is a cross-sectional view showing an example of a recording medium according to an embodiment of the present invention.

DESCRIPTION OF THE EMBODIMENTS

For example, in the case where recording media, on both surfaces of which recording has been performed by an ink jet recording method, are used for an album, the ink receiving layers provided on the recording media overlie each other (come into contact with each other) between the recording media. In such a case, if moisture or the like (water or a water soluble solvent) contained in ink used in printing remains in the ink receiving layers, movement of moisture or the like may occur between the overlaid ink receiving layers. In portions where movement of moisture has occurred, in some cases, undertrapping (a phenomenon in which the ink becomes partially thin and a white appearance is produced) may occur in the image.

In the recording medium described in Patent Document 1, the front and back sides of the recording medium have different ink absorption capabilities. Consequently, when the ink receiving layers overlie each other, movement of moisture or the like occurs markedly because of the difference in absorption capability between the individual ink receiving layers.

In the recording medium described in Patent Document 2, ink absorption layers on the front and back sides of the recording medium are formed so as to have substantially the same structure. Thus, the difference in dot diameter between ink droplets adhering to the ink absorption layers on the front and back sides is decreased, and the difference in image reproducibility between the front and back sides is decreased. However, the movement of moisture or the like at the time when ink receiving layers are overlaid on each other is not taken into consideration. When ink receiving layers are overlaid on each other, in some cases, undertrapping may occur in the image.

The present invention provides a double-sided recording medium in which occurrence of undertrapping in the image is suppressed at the time when recording media are overlaid on each other.

The present invention will now be described in detail.

A recording medium according to the present invention includes a substrate, two or more ink receiving layers disposed on a first surface of the substrate, and two or more ink receiving layers disposed on a second surface of the substrate, the second surface being opposite the first surface. An example of the recording medium of the present invention is shown in Figure. An outermost ink receiving layer 2 and an ink receiving layer 3 adjacent to the outermost ink receiving layer 2 are provided on a first surface of a substrate 1. An outermost ink receiving layer 4 and an ink receiving layer 5 adjacent to the outermost ink receiving layer 4 are provided on a second surface of the substrate, the second surface being opposite the first surface. That is, the recording medium has four or more ink receiving layers in total provided on the front and back surfaces of the substrate, and these ink receiving layers each contain a pigment and a binder.

In the recoding medium of the present invention, the relationships (1) $A_1>A_2$ and (2) $B_1>B_2$ are satisfied, where $A_1$ is the peak (in units of nm) of the pore radius distribution of the outermost ink receiving layer on the first surface side of the substrate, $A_2$ is the peak (in units of nm) of the pore radius distribution of the ink receiving layer adjacent to the outermost ink receiving layer on the first surface side, $B_1$ is the peak (in units of nm) of the pore radius distribution of the outermost ink receiving layer on the second surface side, and $B_2$ is the peak (in units of nm) of the pore radius distribution of the ink receiving layer adjacent to the outermost ink receiving layer on the second surface side.

In the recording medium of the present invention, two or more ink receiving layers are disposed on each of the surfaces (first and second surfaces) of the substrate, and the peak of the pore radius distribution of the outermost ink receiving layer is larger than the peak of the pore radius distribution of the ink receiving layer adjacent to the outermost ink receiving layer. As a result, when ink is applied to the outermost ink receiving layer, the moisture or the like in the ink is attracted by capillary action to the ink receiving layer adjacent to the outermost ink receiving layer, and therefore does not easily remain in the outermost ink receiving layer. With a low content of moisture or the like present in the outermost ink receiving layer, even when ink receiving layers are overlaid on each other, the amount of moisture or the like that moves between the ink receiving layers decreases, and thus it is possible to suppress occurrence of undertrapping in the image.

Now the case will be considered where there is no difference in the peak of the pore radius distribution between the outermost ink receiving layer and the ink receiving layer adjacent to the outermost ink receiving layer or where the peak of the pore radius distribution of the ink receiving layer adjacent to the outermost ink receiving layer is larger than the peak of the outermost ink receiving layer. In this case, the capillary action of pores possessed by the outermost ink receiving layer is equal to or smaller than the capillary action of pores possessed by the ink receiving layer adjacent to the outermost ink receiving layer. Therefore, after recording, moisture or the like present in the outermost ink receiving layer does not easily move to the ink receiving layer (lower layer) adjacent to the outermost ink receiving layer, and the moisture or the like easily remains in the outermost ink receiving layer. Consequently, when ink receiving layers are overlaid on each other, undertrapping may occur in the image.

In addition, in the recording medium of the present invention, a liquid may be applied onto the outermost layer or another layer may be provided on the outermost layer to an extent that does not impair the effect described above.

$A_1$, $A_2$, $B_1$, and $B_2$ must satisfy the relationships (1) and (2) described above. In order to suppress occurrence of undertrapping more satisfactorily, the relationships $A_1-A_2>2.0$ and $B_1-B_2>2.0$ can be satisfied. Furthermore, the relationships $A_1-A_2>4.0$ and $B_1-B_2>4.0$ can be satisfied.

By employing the layer structure described above, most of the moisture or the like moves from the outermost ink receiving layer to the ink receiving layer adjacent to and directly below the outermost ink receiving layer. However, only this will not make all the moisture or the like move, and it is assumed that a slight amount of moisture or the like will remain in the outermost ink receiving layer. Accordingly, in the recording medium of the present invention, $A_1$ and $B_1$ further satisfy the relationship (3) $|A_1-B_1|\leqq 1.0$.

By setting $A_1$ and $B_1$ so as to satisfy the relationship (3), when ink receiving layers are overlaid on each other, combined with the decrease in moisture or the like in the outermost layer according to the relationships (1) and (2), the movement of the moisture or the like remaining in the outermost ink receiving layer can be reduced and occurrence of undertrapping can be suppressed. The relationship $|A_1-B_1|\leqq 0.5$ can be satisfied. When $|A_1-B_1|$ exceeds 1.0, the difference in pore radius between overlaid ink receiving layers increases, and the difference in capillary action between the ink receiving layers tends to increase. Therefore, in some cases, the moisture or the like remaining in the outermost ink receiving layer may move toward the ink receiving layer that has a small peak of the pore radius distribution, resulting in occurrence of undertrapping.

The peak of the pore radius distribution for each layer can be controlled by any known method, such as by appropriately selecting a pigment to be used for each layer, or by adjusting the ratio between the pigment and the binder for each layer.

In the recording medium of the present invention, the arithmetic average roughness Ra, which is specified in JIS B 0601, of each of the outermost ink receiving layer on the first surface side and the outermost ink receiving layer on the second surface side is 0.50 μm or more. When the arithmetic average roughness Ra is 0.50 μm or more, projections and depressions are present on the surface of the ink receiving layer, and therefore, even if ink receiving layers are overlaid on each other after recording, the contact area between the ink receiving layers can be decreased. Consequently, combined with the relationships (1), (2), and (3) described above, the moisture or the like in the ink does not easily move between the ink receiving layers, and thus it is possible to suppress undertrapping. The arithmetic average roughness Ra can be 0.70 μm or more. As long as the arithmetic average roughness Ra is 0.50 μm or more, the effect of the present invention can be obtained without setting an upper limit. However, from the standpoint of image density and image quality after recording, the arithmetic average roughness Ra can be 2.00 μm or less.

The arithmetic average roughness of the ink receiving layer can be adjusted by any known method. Examples of the method include a method of adding inorganic or organic particles with a number-average particle diameter of 1 to 20 μm to the ink receiving layer, a method of carving fine projections and depressions on the surface of the ink receiving layer, and a method in which the ink receiving layer is provided on a substrate having regular or irregular shaped projections and depressions. In the method in which the ink receiving layer is provided on a substrate having projections and depressions, the surface of the substrate is embossed with a regular or irregular shape in advance, and by providing the ink receiving layer thereon, the surface of the ink receiving layer is made to have projections and depressions having the same shape as that of the substrate. This method can be used in the case where the ink receiving layer is composed of a hard porous film. The substrate that can be used in this method is a paper substrate, both surfaces of which are coated with polyolefin. In a typical method in which the surface of a polyolefin resin is embossed with projections and depressions in advance, after a substrate is extrusion-coated with a molten polyolefin resin, the substrate is pressed into contact with an embossing roller to perform texturing of the substrate with fine projections and depressions. Examples of the method of performing texturing include a method in which resin-coated paper obtained by melt extrusion is subjected to embossing calendering treatment at about room temperature, and a method in which, using a cooling roller, the surface of which is carved with a pattern, projections and depressions are formed while being cooled. In the latter method, embossing can be performed at a relatively weak pressure and more accurately and uniformly. In the case of a recording medium obtained by applying a coating liquid for the ink receiving layer to a substrate, the surface of which is provided with projections and depressions in advance, it is necessary to set the surface roughness of the substrate higher than the height of projections and depressions on the surface of the ink receiving layer. Consequently, the arithmetic average roughness Ra specified in JIS B 0601 is preferably 0.70 μm or more, and more preferably 0.90 μm or more.

Furthermore, in the recording medium of the present invention, when the coloring material of ink to be applied for recording is a dye, occurrence of undertrapping can be more satisfactorily suppressed.

<Substrate>

As the substrate to be used in the present invention, paper is suitable. Examples thereof include a film, cast-coated paper, baryta paper, and resin-coated paper (resin-coated paper, both surfaces of which are coated with a resin, such as polyolefin). Examples of the film include transparent thermoplastic resin films, such as polyethylene, polypropylene, polyester, polylactic acid, polystyrene, polyacetate, polyvinyl chloride, cellulose acetate, polyethylene terephthalate, polymethyl methacrylate, and polycarbonate films.

Other examples of the paper that can be used include suitably sized paper, such as water-leaf paper or coated paper, and sheet-shaped materials (synthetic paper and the like) composed of a film that is opacified by filling with an inorganic substance or fine foaming. Sheets composed of glass, a metal, or the like may also be used. Furthermore, in order to improve adhesion strength between the substrate and the ink receiving layer, the surface of the substrate may be subjected to corona discharge treatment or undercoating treatment of various types.

Among the substrates described above, in view of glossiness of the recording medium which has been provided with ink receiving layers, and ease of forming a projection/depression shape on the surface, use of resin-coated paper is desirable.

<Ink Receiving Layer>

The recording medium of the present invention includes two or more ink receiving layers on each of first and second surfaces of the substrate. The ink receiving layers each contain a pigment and a binder.

(Pigment)

As the pigment, for example, inorganic pigments and organic pigments described below may be used. Examples of the inorganic pigments include precipitated calcium carbonate, heavy calcium carbonate, magnesium carbonate, kaolin, aluminum silicate, diatomaceous earth, calcium silicate, magnesium silicate, synthetic amorphous silica, colloidal silica, alumina, hydrated alumina, and magnesium hydroxide. Examples of the organic pigments include styrene-based plastic pigments, acrylic-based plastic pigments, polyethylene particles, microcapsule particles, urea resin particles, and melamine resin particles. These inorganic pigments and organic pigments may be used alone or in combination of two or more as necessary.

Among the pigments described above, from the standpoint that occurrence of undertrapping in the image can be satisfactorily suppressed, use of hydrated alumina is desirable. As the hydrated alumina, for example, one represented by general formula (X) below can be suitably used.

$$Al_2O_{3-n}(OH)_{2n}\cdot mH_2O \quad (X)$$

(wherein n represents any one of 0, 1, 2, and 3, and m represents a value in a range of 0 to 10, preferably, in a range of 0 to 5, m and n not representing 0 at the same time; $mH_2O$ in many cases represents an aqueous phase that can desorb and is not involved in crystal lattice formation, and therefore m can be an integer or a non-integer; and m may reach 0 when this type of material is heated).

The crystal structure of hydrated alumina is known to be amorphous, gibbsite-type, or boehmite-type aluminum hydroxide or hydrated alumina, depending on heat-treating temperature. Any of the crystal structures may be used. Hydrated alumina which exhibits a boehmite structure or which is amorphous as a result of an X-ray diffraction analysis is particularly preferable.

Furthermore, hydrated alumina is preferably selected so that, when the hydrated alumina is formed into ink receiving layers, the peak of the pore radius distribution of each of the ink receiving layers is 7.0 to 13.0 nm. When the peak of the pore radius distribution of the ink receiving layer is in this range, excellent ink absorbency and color developability can be exhibited. When the peak of the pore radius distribution of the ink receiving layer is less than 7.0 nm, because of lack of ink absorbency, even if the amount of a binder relative to the hydrated alumina is adjusted, there may be cases where sufficient ink absorbency cannot be obtained. In particular, when the peak of the pore radius distribution of the ink receiving layer adjacent to the outermost ink receiving layer is less than 7.0 nm, ink absorbency tends to become insufficient.

On the other hand, when the peak of the pore radius distribution of the ink receiving layer is larger than 13.0 nm, the haze of the ink receiving layer increases, and in some cases, it may not be possible to obtain good color developability. In particular, when the peak of the pore radius distribution of the outermost ink receiving layer is more than 13.0 nm, the haze of the layer in which the color developing component in ink is present after recording increases, and there is a tendency that it is not easy to obtain good color developability.

In view of ink absorbency, each ink receiving layer preferably has a pore volume of 0.50 ml/g or more. Furthermore, preferably, the ink receiving layer does not substantially have pores with a pore radius of 25.0 nm or more. When pores with a pore radius of 25.0 nm or more are present, the haze of the ink receiving layer increases, and in some cases, it may not be possible to obtain good color developability.

Note that the peak of the pore radius distribution and the pore volume in the present invention are obtained, using the Barrett-Joyner-Halenda (BJH) method, from the adsorption-desorption isotherm line of nitrogen gas measured by subjecting the recording medium to the nitrogen adsorption-desorption method. When the recording medium is measured using the nitrogen adsorption-desorption method, parts other than the ink receiving layer (i.e., substrate, resin-coated layer, and the like) are also measured. However, the parts other than the ink receiving layer do not substantially have pores in the range of 1 to 100 nm that can be generally measured by the nitrogen adsorption-desorption method. For this reason, measurement of the entire recording medium by the nitrogen adsorption-desorption method is substantially the same as measurement of the average pore radius of the ink receiving layer. This is obvious from the fact that, for example, when the pore distribution of a substrate mainly composed of pulp or resin-coated paper, both surfaces of which are coated with a resin, is measured by the nitrogen adsorption-desorption method, substantially no pores are observed in the range of 1 to 100 nm.

In the recording medium of the present invention, two or more ink receiving layers are disposed on each of the first surface side and the second surface side. In order to measure the peak of the pore radius distribution and the pore volume for each layer, each layer is formed on a substrate and measurement is performed by the nitrogen adsorption-desorption method.

In the case where each of the individual layers has two or more peaks of the pore radius distribution, the highest peak value among the two or more peaks in each layer is defined as $A_1$, $A_2$, $B_1$, or $B_2$, and the relationships (1), (2), and (3) must be satisfied.

In order to obtain the pore radius of hydrated alumina described above during the formation of the ink receiving layer, hydrated alumina having a BET specific surface area of preferably 100 to 200 $m^2/g$ as determined by the BET method is used. The BET specific surface area of the hydrated alumina is more preferably 125 $m^2/g$ or more and 175 $m^2/g$ or less. The BET method is one of methods for determining surface areas of powder by use of a gas-phase adsorption method, and is a method of determining the total surface area of 1 g of a sample (i.e., the specific surface area) from an adsorption isotherm line. In the BET method, nitrogen gas is usually used as the adsorption gas, and in a most frequently used method, the amount of adsorption is determined in accordance with a change in pressure or volume of adsorbed gas. The most famous equation expressing the isotherm line of multilayer molecular adsorption is the Brunauer-Emmett- Teller equation referred to as the BET equation, which is widely used for determination of a specific surface area. In the BET method, the adsorption amount is determined on the basis of the BET equation, and by multiplying the adsorption amount by the area occupied by one adsorbed molecule on the surface, the specific surface area is obtained. In the BET method, in measurement of the nitrogen adsorption-desorption method, several points of adsorption amount as a function of relative pressure are measured, and the slope and intercept of the plots are calculated by the method of least squares, thereby finding the specific surface area. In order to increase the accuracy of measurement, preferably at least five points and more preferably 10 or more points of adsorption amount as a function of relative pressure are measured.

Preferably, the hydrated alumina has a tabular shape, in which the average aspect ratio is 3.0 to 10 and the length/breadth ratio of the flat plate surface is 0.60 to 1.0. Note that the aspect ratio can be obtained by the method described in Japanese Patent Publication No. 5-16015. That is, the aspect ratio is defined as the ratio of the diameter to the thickness of a particle. Here, the term "diameter" means the diameter (circle equivalent diameter) of a circle having an area equal to the projected area of a particle when the hydrated alumina is observed by a microscope or an electron microscope. The length/breadth ratio of the flat plate surface means the ratio of the minimum diameter to maximum diameter of the flat plate surface when a particle is observed by a microscope in the same manner as in the case of the aspect ratio.

When hydrated alumina having an aspect ratio out of the range described above is used, the range of pore distribution of the resulting ink receiving layer may be narrowed. Therefore, there may be a case where it is difficult to produce hydrated alumina having a uniform particle diameter. Furthermore, when hydrated alumina having a length/breadth ratio out of the range described above is used, the pore diameter distribution of the ink receiving layer is narrowed.

It is known that hydrated alumina has a ciliary shape or a non-ciliary shape. According to the findings of the inventors of the present invention, tabular hydrated alumina has higher dispersibility than ciliary hydrated alumina. Furthermore, there may be a case where ciliary hydrated alumina is made to orient parallel to the surface of the substrate when being applied, and the resulting pores are decreased in size, thus decreasing ink absorbency of the ink receiving layer. In contrast, tabular hydrated alumina has a weak tendency of orienting when being applied, and does not easily influence the size of pores formed in the ink receiving layer or ink absorbency. It is therefore preferable to use tabular hydrated alumina.

(Binder)

Examples of the binder to be used in the present invention include starch derivatives, such as oxidized starch, etherified starch, and phosphorylated starch; cellulose derivatives, such as carboxymethyl cellulose and hydroxyethyl cellulose; casein, gelatin, soybean protein, polyvinyl alcohol or their derivatives; latexes of conjugated polymers, such as polyvinyl pyrrolidone, maleic anhydride resins, styrene-butadiene copolymers, and methyl methacrylate-butadiene copolymers; latexes of acrylic polymers, such as acrylates and methacrylates; latexes of vinyl polymers, such as ethylene-vinyl acetate copolymers; functional-group-modified polymer latexes obtained by polymerizing monomers containing a functional group such as a carboxyl group from the above various polymers; cationized polymers obtained by cationizing the above various polymers by using a cationic group and those obtained by cationizing the surface of the above various polymers with cationic surfactants; polymers obtained by polymerizing the above various polymers in the presence of cationic polyvinyl alcohol to distribute the polyvinyl alcohol onto the surface of the polymers; polymers obtained by polymerizing the above various polymers in a suspension solution of cationic colloid particles to distribute the cationic colloid particles onto the surface thereof; aqueous binders, for example, thermosetting synthetic resins, such as melamine resins and urea resins; polymer or copolymer resins of acrylates or methacrylates, such as a polymethyl methacrylate; and synthetic resin-based binders, such as polyurethane resins, unsaturated polyester resins, vinyl chloride-vinyl acetate copolymers, polyvinyl butyral, and alkyd resins.

These binders may be used alone or in a mixture of a plurality thereof. Above all, polyvinyl alcohol is most preferably used as the binder. In particular, ordinary polyvinyl alcohol obtained by hydrolyzing polyvinyl acetate is preferable. As the polyvinyl alcohol, those having an average degree of polymerization of 1,500 or more are preferably used, and those having an average degree of polymerization of 2,000 to 5,000 are more preferable. The degree of saponification of the polyvinyl alcohol is preferably 80 to 100, and more preferably 85 to 100.

In addition, it is also possible to use modified polyvinyl alcohol, such as polyvinyl alcohol, the end of which is cationically modified, or anionically modified polyvinyl alcohol having an anionic group.

The ratio by mass of the binder to the pigment (binder/pigment) in the ink receiving layer is preferably 1/10 to 10/1, and more preferably 1/5 to 5/1.

(Other Materials)

In the present invention, the ink receiving layer may contain the materials described below as necessary.

For example, the ink receiving layer may contain at least one of boric acid and a borate. By adding boric acid or a borate to the ink receiving layer, cracks can be prevented from occurring in the ink receiving layer. Examples of the boric acid include orthoboric acid ($H_3BO_3$), metaboric acid, and hypoboric acid. The borate is preferably water-soluble salts of the above boric acids. Specific examples of the borate include the following alkali earth metal salts of boric acid and the like: alkali metal salts, such as sodium salts of boric acid (e.g., $Na_2B_4O_7 \cdot 10H_2O$ and $NaBO_2 \cdot 4H_2O$); potassium salts of boric acid (e.g., $K_2B_4O_7 \cdot 5H_2O$ and $KBO_2$); ammonium salts of boric acid (e.g., $NH_4B_4O_9 \cdot 3H_2O$ and $NH_4BO_2$); and magnesium salts and calcium salts of boric acid. Among these boric acids and the like, orthoboric acid is preferably used from the standpoint of stability of the coating liquid with time and the effect of suppressing the occurrence of cracks. The boric acid or the like is used preferably in an amount in the range of 10% by mass to 50% by mass, in terms of boric acid solid content, relative to the binder in the upper and lower layers. When the amount exceeds the above-mentioned range, stability of the coating liquid with time may be degraded in some cases. That is, when an ink absorbent recording medium is produced, the coating liquid is used over a long period of time. If the amount of boric acid is large, there may be a case where the viscosity of the coating liquid increases and a gelled product is generated. It is therefore necessary to replace the coating liquid and to clean the coater head frequently, resulting in a marked decrease in productivity. Moreover, when the amount exceeds the above-mentioned range, there may be a case where the ink receiving layer cannot have a uniform and good glossy surface. Even when the amount of boric acid or the like used is within the above-mentioned range, depending on production conditions and the like, cracks may occur in the ink receiving layer. It is therefore necessary to select the range of an appropriate amount of use.

The ink receiving layer may also contain, as a dye fixing agent, a cationic substance, such as a cationic polymer. The cationic polymer improves, in particular, the dyeing property of a magenta dye in the ink receiving layer, and it is possible to reduce migration of the magenta dye, such as an anthrapyridone-based or quinacridone-based dye, under high-temperature high-humidity conditions.

For example, the following acids or salts may be added, as a pH regulator, into a coating liquid for forming the ink receiving layer: formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, aspartic acid, glutamic acid, pimelic acid, suberic acid, and methansulfonic acid; inorganic acids, such as hydrochloric acid, nitric acid, and phosphoric acid; and salts of these acids. In order to disperse hydrated alumina in water, a monobasic acid is preferably used. Therefore, among these pH regulators, it is preferable to use an organic acid, such as formic acid, acetic acid, glycolic acid, or methansulfonic acid; hydrochloric acid; nitric acid; or the like. Furthermore, as other additives for the coating liquid, a pigment dispersant, a thickener, a fluidity improver, an antifoaming agent, a foam-limiting agent, a surfactant, a releasing agent, a penetrating agent, a coloring pigment, and a coloring dye may be used. Furthermore, a fluorescent whitening agent, an ultraviolet absorber, an antioxidant, an antiseptic, a mildew-proofing agent, a water-proofing agent, a curing agent, a weather-proof material, and the like may be also be used.

<Application Method of Coating Liquid for Ink Receiving Layer>

A coating liquid for forming the ink receiving layer may be applied by on-machine or off-machine coating, with any of various curtain coaters, a coater using an extrusion system, or a coater using a slide hopper system. When the coating liquid is applied, the coating liquid may be heated or the coater head may be heated for the purpose of, for example, regulating the viscosity of the coating liquid. After the coating liquid is applied, drying is performed, preferably, using a hot air drier, such as a linear tunnel drier, an arch drier, an air loop drier, or a sign-curve air float drier. A drier utilizing infrared rays, a heating drier, a microwave drier, or the like may also be appropriately selected for use.

The coating amount of the ink receiving layer is not particularly limited as long as ink absorbency is satisfactory. The coating amount of the outermost ink receiving layer is preferably 10.0 g/m$^2$ or less. If the coating amount of the outermost ink receiving layer is 10.0 g/m$^2$ or less, when ink is printed on the ink receiving layer, moisture or the like in the ink quickly moves to the ink receiving layer adjacent to the outermost ink receiving layer, and thus occurrence of undertrapping can be effectively suppressed.

EXAMPLES

The present invention will be described below in more detail on the basis of Examples and Comparative Examples, but it is to be understood that the invention is not limited thereto. In the following description, "part" or "%" is relative to mass, unless otherwise noted.

<Method of Producing Recording Medium>

(Production of Substrate)

First, 20 parts of precipitated calcium carbonate was added to 100 parts of slurry of bleached hardwood kraft pulp, and 2 parts of cationic starch and 0.3 parts of an alkenylsuccinic anhydride-based neutral sizing agent were further added thereto, followed by thorough mixing to prepare a paper material. Next, the paper material was dried, using a multi-cylinder Fourdrinier paper machine, to a water content of 10%. Then, a 7% solution of oxidized starch was applied to both surfaces of the resulting paper in an amount of 4 g/m$^2$ using a sizing press machine, followed by drying to a water content of 7%. Thereby, base paper with a basis weight of 120 g/m$^2$ was obtained. A resin composition composed of 70 parts of high-density polyethylene and 20 parts of low-density polyethylene was applied by melt extrusion onto front and back surfaces of the base paper such that the coating amount was 20.0 g/m$^2$. Immediately after this, using a cooling roller having irregular shaped projections and depressions, four types of embossing were performed on the polyethylene surfaces under cooling. Different embossing patterns were obtained by adjusting the density and the height of projections and depressions. In such a manner, substrates A, B, C, and D with a basis weight of 160 g/m$^2$ were produced.

The arithmetic average surface roughness Ra of the individual substrates was measured. In the measurement, each substrate was cut into a size suitable for measurement, and a SURFCOM 1500DX (manufactured by Tokyo Seimitsu Co., Ltd.) was used in accordance with the method specified in JIS B 0601. As a result of the measurement, the arithmetic average surface roughness Ra was 0.59 μm for the substrate A, 0.72 μm for the substrate B, 0.95 μm for the substrate C, and 2.10 μm for the substrate D.

(Preparation of Coating Liquid 1 for Ink Receiving Layer)

Acetic anhydride (2.0 parts) was added to ion-exchange water (314.7 parts), followed by thorough mixing. Then, 100 parts of hydrated alumina (Disperal HP18, manufactured by SASOL), as inorganic fine particles, was added thereto, followed by thorough mixing, to thereby obtain colloidal sol. The resulting colloidal sol was appropriately diluted with ion-exchange water such that the content of hydrated alumina was 22%, and thereby, colloidal sol was obtained.

Meanwhile, polyvinyl alcohol (PVA235, degree of polymerization: 3,500, degree of saponification: 88%; manufactured by Kuraray Co., Ltd.) was dissolved in ion-exchange water to obtain an aqueous solution of polyvinyl alcohol having a solid content of 8.0%. Then, the resulting polyvinyl alcohol solution was mixed with the colloidal sol prepared as described above such that the ratio of the solid content of polyvinyl alcohol to the solid content of hydrated alumina [(binder)/(hydrated alumina)×100] was 10%. Next, a 3.0% aqueous solution of boric acid was mixed in the mixture such that the solid content of boric acid was 1.5% on the basis of the solid content of the hydrated alumina to obtain coating liquid 1 for ink receiving layer.

(Preparation of Coating Liquid 2 for Ink Receiving Layer)

Coating liquid 2 for ink receiving layer was obtained as in the preparation of coating liquid 1 for ink receiving layer except that hydrated alumina (Disperal HP18) was changed to hydrated alumina (Disperal HP14, manufactured by SASOL).

(Preparation of Coating Liquid 3 for Ink Receiving Layer)

Coating liquid 3 for ink receiving layer was obtained as in the preparation of coating liquid 1 for ink receiving layer except that hydrated alumina (Disperal HP18) was changed to hydrated alumina (Disperal HP10, manufactured by SASOL).

(Preparation of Coating Liquid 4 for Ink Receiving Layer)

A silica dispersion liquid was obtained by dispersing 100 parts of silica (A300, manufactured by Nippon Aerosil Co., Ltd.) and 4 parts of a cationic polymer (SHALLOL DC902P, manufactured by Dai-ichi Kogyo Seiyaku Co., Ltd.) in water such that the solid concentration was 18%, and further dispersing with a high pressure homogenizer.

Meanwhile, polyvinyl alcohol (PVA235, degree of polymerization: 3,500, degree of saponification: 88%; manufactured by Kuraray Co., Ltd.) was dissolved in ion-exchange water to obtain an aqueous solution of polyvinyl alcohol having a solid content of 8.0%. Then, the resulting polyvinyl alcohol solution was mixed with the colloidal sol prepared as described above such that the ratio of the solid content of polyvinyl alcohol to the solid content of silica [(binder)/(silica)×100] was 15%. Next, a 3.0% aqueous solution of boric acid was mixed in the mixture such that the solid content of boric acid was 2.3% on the basis of the solid content of the silica to obtain coating liquid 4 for ink receiving layer.

(Preparation of Coating Liquid 5 for Ink Receiving Layer)

The coating liquid 2 for ink receiving layer and the coating liquid 3 for ink receiving layer were mixed such that the solid content ratio between Disperal HP14 and Disperal HP10 was 40:60 to obtain coating liquid 5 for ink receiving layer.

(Preparation of Coating Liquid 6 for Ink Receiving Layer)

The coating liquid 1 for ink receiving layer and the coating liquid 2 for ink receiving layer were mixed such that the solid content ratio between Disperal HP18 and Disperal HP14 was 20:80 to obtain coating liquid 6 for ink receiving layer.

(Preparation of Coating Liquid 7 for Ink Receiving Layer)

The coating liquid 2 for ink receiving layer and the coating liquid 3 for ink receiving layer were mixed such that the solid content ratio between Disperal HP14 and Disperal HP10 was 70:30 to obtain coating liquid 7 for ink receiving layer.

(Preparation of Coating Liquid 8 for Ink Receiving Layer)

The coating liquid 1 for ink receiving layer and the coating liquid 2 for ink receiving layer were mixed such that the solid content ratio between Disperal HP18 and Disperal HP14 was 90:10 to obtain coating liquid 8 for ink receiving layer.

(Preparation of Coating Liquid 9 for Ink Receiving Layer)

The coating liquid 1 for ink receiving layer and the coating liquid 2 for ink receiving layer were mixed such that the solid content ratio between Disperal HP18 and Disperal HP14 was 70:30 to obtain coating liquid 9 for ink receiving layer.

(Preparation of Coating Liquid 10 for Ink Receiving Layer)

The coating liquid 2 for ink receiving layer and the coating liquid 3 for ink receiving layer were mixed such that the solid content ratio between Disperal HP14 and Disperal HP10 was 80:20 to obtain coating liquid 10 for ink receiving layer.

(Preparation of Coating Liquid 11 for Ink Receiving Layer)

The coating liquid 1 for ink receiving layer and the coating liquid 2 for ink receiving layer were mixed such that the solid content ratio between Disperal HP18 and Disperal HP14 was 60:40 to obtain coating liquid 11 for ink receiving layer.

<Measurement of Peak of Pore Radius Distribution>

Each of the coating liquids for ink receiving layer was applied to a first surface (front surface) of the substrate A such that the coating amount after drying was 30.0 g/m$^2$. The application of the coating liquids was performed at 40° C. using a slide die. Then, drying was performed at 60° C. to obtain a recording medium for measuring the peak of the pore radius distribution. The peak of the pore radius distribution of the ink receiving layer of the resulting recording medium was measured using the apparatus described below.

Measurement of pore radius: automatic specific surface area/pore distribution measurement apparatus TriStar3000 (manufactured by Shimadzu Corporation)

Sample pretreatment: Vacu-prep 061 (manufactured by Shimadzu Corporation)

The recording medium was sheet cut to a size of 5.0×10.0 cm, and the sheet was cut into a size that can be put in the ⅜ in cell for measuring the pore radius. Then, the cut recording medium is placed in the cell, and using Vacu-prep 061, deaeration and drying were performed while heating at 80° C. until 20 millitorr or less was reached. The pore diameter distribution of the sample subjected to deaeration and drying was measured by the nitrogen adsorption-desorption method using TriStar3000. After the measurement, using the data obtained on the nitrogen desorption side, the peak of the pore radius distribution was finally obtained. The measurement results are shown in Table 1.

TABLE 1

| Coating liquid | Peak of pore radius distribution (nm) |
|---|---|
| 1 | 13.0 |
| 2 | 10.0 |
| 3 | 7.0 |
| 4 | 12.0 |
| 5 | 8.2 |
| 6 | 10.6 |
| 7 | 9.1 |
| 8 | 12.7 |
| 9 | 12.1 |
| 10 | 9.4 |
| 11 | 11.8 |

Example 1

Coating liquid 3 was applied to the first surface (front surface) of substrate C such that the coating amount after drying was 30.0 g/m$^2$, and drying was performed at 60° C. An ink receiving layer, as the lower layer on the first surface side, was thereby provided. Next, coating liquid 3 was applied to the second surface (back surface) of substrate C such that the coating amount after drying was 30.0 g/m$^2$, and drying was performed at 60° C. An ink receiving layer, as the lower layer on the second surface side, was thereby provided.

Next, coating liquid 1 was applied onto the ink receiving layer formed on the first surface such that coating amount after drying was 10.0 g/m$^2$, and drying was performed at 60° C. An ink receiving layer, as the upper layer on the first surface side, was thereby provided. Then, coating liquid 1 was applied onto the ink receiving layer formed on the second surface such that coating amount after drying was 10.0 g/m$^2$, and drying was performed at 60° C. An ink receiving layer, as the upper layer on the second surface side, was thereby provided. In such a manner, recording medium 1 was obtained. The application of the coating liquids was performed at 40° C. using a slide die.

Examples 2 to 25

Recording media 2 to 25 were obtained as in Example 1 except that the types of the substrate, the types of the coating liquid, and the coating amounts were as shown in Table 2.

Comparative Examples 1 to 4

Recording media 26 to 29 were obtained as in Example 1 except that the types of the substrate, the types of the coating liquid, and the coating amounts were as shown in Table 2.

Referring to Table 2, in the measurement of the arithmetic average roughness of the first surface side and the second surface side, the recording media produced were cut into a size suitable for measurement, and a SURFCOM 1500DX (manufactured by Tokyo Seimitsu Co., Ltd.) was used in accordance with the method specified in JIS B 0601.

<Evaluation>

The produced recording media 1 to 29 were evaluated as follows.

First, two recording media of the same type were prepared. Next, image 1 described below was recorded on the first surface side of one of the recording media using an ink jet printer (iP8600, manufactured by CANON) in the Super-photo mode. Next, image 2 described below was recorded on the second surface side of the other recording medium using an ink jet printer (iP8600, manufactured by CANON) in the Super-photo mode. BCI-7E (dye ink, manufactured by CANON) was used as ink in each case.

Image 1: image obtained by filling in a region of 15 cm×15 cm in the RGB mode of PhotoShop7.0, (R,G,B)=(0,0,0).

Image 2: image obtained by filling in a region of 5 cm×5 cm in the RGB mode of PhotoShop7.0, (R,G,B)=(255,255,0).

After the image was recorded, drying was performed under the conditions of 30 minutes at 23° C. and 60% RH. After drying, printed surfaces (ink receiving layers) of the two recording media were overlaid on each other such that image 1 and image 2 were superimposed on each other, and kept for 24 hours. After being kept for 24 hours, occurrence of under-trapping in image 1 was visually evaluated on the basis of criteria described below. The results are shown in Table 2.

4: Undertrapping does not occur.

3: Undertrapping slightly occurs.

2: Undertrapping occurs to some extent.

1: Undertrapping occurs to a large degree.

TABLE 2

| | | | Coating | | | | | | | |
|---|---|---|---|---|---|---|---|---|---|---|
| | | | First surface side | | | | Second surface side | | | |
| | | | Upper layer | | Lower layer | | Upper layer | | Lower layer | |
| | Recording medium | Substrate | Coating liquid | Coating amount ($g/m^2$) | Coating liquid | Coating amount ($g/m^2$) | Coating liquid | Coating amount ($g/m^2$) | Coating liquid | Coating amount ($g/m^2$) |
| Example 1 | 1 | C | 1 | 10.0 | 3 | 30.0 | 1 | 10.0 | 3 | 30.0 |
| Example 2 | 2 | C | 1 | 12.0 | 3 | 28.0 | 1 | 12.0 | 3 | 28.0 |
| Example 3 | 3 | C | 1 | 10.0 | 3 | 30.0 | 7 | 10.0 | 3 | 30.0 |
| Example 4 | 4 | B | 1 | 10.0 | 3 | 30.0 | 1 | 10.0 | 3 | 30.0 |
| Example 5 | 5 | D | 1 | 10.0 | 3 | 30.0 | 1 | 10.0 | 3 | 30.0 |
| Example 6 | 6 | C | 1 | 12.0 | 3 | 28.0 | 8 | 12.0 | 3 | 28.0 |
| Example 7 | 7 | C | 1 | 12.0 | 3 | 28.0 | 9 | 12.0 | 3 | 28.0 |
| Example 8 | 8 | C | 2 | 10.0 | 3 | 30.0 | 2 | 10.0 | 3 | 30.0 |
| Example 9 | 9 | C | 2 | 12.0 | 3 | 28.0 | 2 | 12.0 | 3 | 28.0 |
| Example 10 | 10 | B | 2 | 10.0 | 3 | 30.0 | 2 | 10.0 | 3 | 30.0 |
| Example 11 | 11 | C | 2 | 10.0 | 3 | 30.0 | 10 | 10.0 | 3 | 30.0 |
| Example 12 | 12 | C | 2 | 12.0 | 3 | 28.0 | 10 | 12.0 | 3 | 28.0 |
| Example 13 | 13 | C | 2 | 10.0 | 5 | 30.0 | 2 | 10.0 | 5 | 30.0 |
| Example 14 | 14 | C | 2 | 12.0 | 5 | 28.0 | 2 | 12.0 | 5 | 28.0 |
| Example 15 | 15 | C | 4 | 10.0 | 6 | 30.0 | 4 | 10.0 | 6 | 30.0 |
| Example 16 | 16 | C | 4 | 12.0 | 6 | 28.0 | 4 | 12.0 | 6 | 28.0 |
| Example 17 | 17 | C | 2 | 10.0 | 5 | 30.0 | 7 | 10.0 | 5 | 30.0 |
| Example 18 | 18 | C | 2 | 12.0 | 5 | 28.0 | 7 | 12.0 | 5 | 28.0 |
| Example 19 | 19 | B | 2 | 12.0 | 5 | 28.0 | 7 | 12.0 | 5 | 28.0 |
| Example 20 | 20 | C | 4 | 10.0 | 3 | 30.0 | 4 | 10.0 | 3 | 30.0 |
| Example 21 | 21 | C | 4 | 12.0 | 3 | 28.0 | 4 | 12.0 | 3 | 28.0 |
| Example 22 | 22 | C | 4 | 10.0 | 7 | 30.0 | 4 | 10.0 | 7 | 30.0 |
| Example 23 | 23 | C | 4 | 12.0 | 7 | 28.0 | 4 | 12.0 | 7 | 28.0 |
| Example 24 | 24 | C | 1 | 10.0 | 3 | 30.0 | 1 | 12.0 | 3 | 30.0 |
| Example 25 | 25 | C | 2 | 8.0 | 3 | 32.0 | 2 | 8.0 | 3 | 32.0 |
| Comparative Example 1 | 26 | C | 1 | 10.0 | 1 | 30.0 | 1 | 10.0 | 1 | 30.0 |
| Comparative Example 2 | 27 | C | 1 | 10.0 | 3 | 30.0 | 11 | 10.0 | 3 | 30.0 |
| Comparative Example 3 | 28 | A | 1 | 10.0 | 2 | 30.0 | 1 | 10.0 | 3 | 30.0 |
| Comparative Example 4 | 29 | C | 5 | 10.0 | 2 | 30.0 | 5 | 10.0 | 2 | 30.0 |

| | Peak of pore radius distribution | | | | | | |
|---|---|---|---|---|---|---|---|
| | First surface side | | Second surface side | | Arithmetic average roughness Ra | | Suppression of under-trapping |
| | Upper layer | Lower layer | Upper layer | Lower layer | | | |
| | Peak $A_1$ (nm) | Peak $A_2$ (nm) | Peak $B_1$ (nm) | Peak $B_2$ (nm) | Surface on first side (μm) | Surface on second side (μm) | |
| Example 1 | 13.0 | 7.0 | 13.0 | 7.0 | 0.75 | 0.74 | 4 |
| Example 2 | 13.0 | 7.0 | 13.0 | 7.0 | 0.71 | 0.72 | 4 |
| Example 3 | 13.0 | 7.0 | 12.1 | 7.0 | 0.74 | 0.72 | 4 |
| Example 4 | 13.0 | 7.0 | 13.0 | 7.0 | 0.51 | 0.53 | 4 |
| Example 5 | 13.0 | 7.0 | 13.0 | 7.0 | 1.92 | 1.90 | 4 |
| Example 6 | 13.0 | 7.0 | 12.7 | 7.0 | 0.72 | 0.74 | 4 |

TABLE 2-continued

| | | | | | | | |
|---|---|---|---|---|---|---|---|
| Example 7 | 13.0 | 7.0 | 12.1 | 7.0 | 0.73 | 0.72 | 3 |
| Example 8 | 10.0 | 7.0 | 10.0 | 7.0 | 0.73 | 0.74 | 4 |
| Example 9 | 10.0 | 7.0 | 10.0 | 7.0 | 0.71 | 0.72 | 3 |
| Example 10 | 10.0 | 7.0 | 10.0 | 7.0 | 0.54 | 0.54 | 3 |
| Example 11 | 10.0 | 7.0 | 9.4 | 7.0 | 0.74 | 0.72 | 3 |
| Example 12 | 10.0 | 7.0 | 9.4 | 7.0 | 0.76 | 0.75 | 2 |
| Example 13 | 10.0 | 8.2 | 10.0 | 8.2 | 0.70 | 0.72 | 3 |
| Example 14 | 10.0 | 8.2 | 10.0 | 8.2 | 0.74 | 0.73 | 2 |
| Example 15 | 12.0 | 10.6 | 12.0 | 10.6 | 0.75 | 0.74 | 2 |
| Example 16 | 12.0 | 10.6 | 12.0 | 10.6 | 0.72 | 0.75 | 2 |
| Example 17 | 10.0 | 8.2 | 9.1 | 8.2 | 0.74 | 0.72 | 2 |
| Example 18 | 10.0 | 8.2 | 9.1 | 8.2 | 0.71 | 0.72 | 2 |
| Example 19 | 10.0 | 8.2 | 9.1 | 8.2 | 0.52 | 0.55 | 2 |
| Example 20 | 12.0 | 7.0 | 12.0 | 7.0 | 0.76 | 0.73 | 4 |
| Example 21 | 12.0 | 7.0 | 12.0 | 7.0 | 0.72 | 0.72 | 3 |
| Example 22 | 12.0 | 9.1 | 12.0 | 9.1 | 0.72 | 0.74 | 3 |
| Example 23 | 12.0 | 9.1 | 12.0 | 9.1 | 0.73 | 0.71 | 2 |
| Example 24 | 13.0 | 7.0 | 13.0 | 7.0 | 0.74 | 0.71 | 4 |
| Example 25 | 10.0 | 7.0 | 10.0 | 7.0 | 0.72 | 0.70 | 4 |
| Comparative Example 1 | 13.0 | 13.0 | 13.0 | 13.0 | 0.71 | 0.72 | 1 |
| Comparative Example 2 | 13.0 | 7.0 | 11.8 | 7.0 | 0.75 | 0.72 | 1 |
| Comparative Example 3 | 13.0 | 7.0 | 13.0 | 7.0 | 0.41 | 0.42 | 1 |
| Comparative Example 4 | 8.2 | 10.0 | 8.2 | 10.0 | 0.72 | 0.73 | 1 |

As is evident from Table 2, in the recording media of Examples 1 to 25, occurrence of undertrapping is suppressed even when the ink receiving layers are overlaid on each other.

In the recording media of Comparative Examples 1 and 4, the relationships $A_1>A_2$ and $B_1>B_2$ are not satisfied, and undertrapping occurs. In the recording medium of Comparative Example 2, the relationship $|A_1-B_1|\leqq 1.0$ is not satisfied, and undertrapping occurs. In the recording medium of Comparative Example 3, the arithmetic average roughness Ra of each of the outermost ink receiving layer on the first surface side and the outermost ink receiving layer on the second surface side is not 0.5 μm or more, and undertrapping occurs.

The present invention can provide a double-sided recording medium in which occurrence of undertrapping in the image is suppressed at the time when recording media are overlaid on each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-017008 filed Jan. 28, 2010 and No. 2010-277324 filed Dec. 13, 2010, which are hereby incorporated by reference herein in their entirety.

What is claimed is:

1. A recording medium comprising:

a substrate;

two or more ink receiving layers disposed on a first surface of the substrate; and two or more ink receiving layers disposed on a second surface of the substrate, the second surface being opposite the first surface, wherein the ink receiving layers each contain a pigment and a binder;

the relationships (1) $A_1>A_2$, (2) $B_1>B_2$, and (3) $|A_1-B_1|\leqq 1.0$ are satisfied, where $A_1$ is the peak (in units of nm) of the pore radius distribution of the outermost ink receiving layer on the first surface side, $A_2$ is the peak (in units of nm) of the pore radius distribution of the ink receiving layer adjacent to the outermost ink receiving layer on the first surface side, $B_1$ is the peak (in units of nm) of the pore radius distribution of the outermost ink receiving layer on the second surface side, and $B_2$ is the peak (in units of nm) of the pore radius distribution of the ink receiving layer adjacent to the outermost ink receiving layer on the second surface side; and the arithmetic average roughness Ra, which is specified in JIS B 0601, of each of the outermost ink receiving layer on the first surface side and the outermost ink receiving layer on the second surface side is 0.50 μm or more.

2. The recording medium according to claim 1, wherein the relationships $A_1-A_2>2.0$ and $B_1-B_2>2.0$ are satisfied.

3. The recording medium according to claim 1, wherein the arithmetic average roughness Ra, which is specified in JIS B 0601, of each of the outermost ink receiving layer on the first surface side and the outermost ink receiving layer on the second surface side is 0.70 μm or more.

4. The recording medium according to claim 1, wherein the coating amount of each of the outermost ink receiving layer on the first surface side and the outermost ink receiving layer on the second surface side is 10.0 g/m$^2$ or less.

5. The recording medium according to claim 1, wherein the pigment is hydrated alumina.

* * * * *